US005217421A

United States Patent [19]

Chrysler

[11] Patent Number: 5,217,421

[45] Date of Patent: Jun. 8, 1993

[54] PORTABLE SAFETY DEVICE FOR WEIGHT TRAINING

[75] Inventor: Ronald S. Chrysler, Denver, Colo.

[73] Assignee: Rocky Mountain Gym Equipment Co., Inc., Commerce City, Colo.

[21] Appl. No.: 824,578

[22] Filed: Jan. 23, 1992

[51] Int. Cl.[5] ..... A63B 21/078

[52] U.S. Cl. ..... 482/104

[58] Field of Search ..... 482/104, 106, 142; 248/175, 214

[56] References Cited

U.S. PATENT DOCUMENTS

| | | | |
|---|---|---|---|
| 4,205,838 | 6/1980 | McIntosh . | |
| 4,249,726 | 2/1981 | Faust . | |
| 4,411,425 | 10/1983 | Milnar . | |
| 4,492,499 | 1/1985 | Gasper | 248/214 X |
| 4,635,930 | 1/1987 | Cormier . | |
| 4,650,186 | 3/1987 | McCreery et al. . | |
| 4,757,998 | 7/1988 | Landin . | |
| 4,773,642 | 9/1988 | Croz | 482/104 |
| 4,799,673 | 1/1989 | Selle . | |
| 4,799,674 | 1/1989 | Ochab . | |
| 4,928,961 | 5/1990 | Madden | 482/104 |
| 5,082,260 | 1/1992 | Dinelli | 482/104 |

*Primary Examiner*—Robert Bahr

*Attorney, Agent, or Firm*—John E. Reilly

[57] ABSTRACT

A portable safety device is adapted for releasable mounting on a weight training bench and includes a base frame which fits over the bench, spaced upright side frame members extending upwardly from opposite sides of the base frame with forward horizontal extensions on the side frame members so that when the weight lifter is in a prone position with his/her head between the side frame members, the weight lifter is protected from injury in the event that the weight lifter should lose control of the barbell during bench press exercises.

11 Claims, 1 Drawing Sheet

PORTABLE SAFETY DEVICE FOR WEIGHT TRAINING

This invention relates to weight lifting apparatus; and more particularly relates to a novel and improved portable safety device to prevent injury to the weight lifter in the event that he/she is unable to complete a weight lifting exercise and return the barbell to its original supported position.

BACKGROUND AND FIELD OF THE INVENTION

In weight lifting, a popular exercise is the bench press in which the weight lifter must assume a prone position on a bench, remove the barbell from a safety shelf, and to lift and lower the barbell through a series of repetitions. However, if the weight lifter is unable to complete a repetition and return the barbell to its original position, there is a real danger that the barbell will fall on the head, neck or upper torso of the weight lifter and may cause serious injury.

In the past, safety apparatus has been devised to avoid such incidents as described. However, to the best of my knowledge, apparatus that is presently available either does not fully protect the head, neck and shoulders of the weight lifter against possible injury or is not sufficiently portable that it can be easily placed on and removed from the weight training bench. In other words, the safety apparatus essentially forms a permanent part of the bench and the bench is not easily utilized for performing other exercises. A representative approach which has been taken in the past are disclosed in U.S. Pat. No. 4,757,998 to M. G. Landin in which a stand fits over opposite sides of a weight lifter's bench and a pair of bars are pivotally mounted on each side of the stand so that they can be moved to an out-of-the-way position and can be adjusted to different levels. Another approach is disclosed in U.S. Pat. No. 4,635,930 to G. Cormier in which a bench pressing device is mounted on an adjustable stand with upstanding solid sides; however, stands of this type have a tendency to obstruct the freedom of movement of the weight lifter when the head is placed between the sides of the stand. U.S. Pat. No. 4,411,425 to J. B. Milnar also discloses a resting stand which must be hooked to the bench itself but is not really intended as a protective device which will adequately protect the head, neck and shoulders of the weight lifter. Other U.S. Pat. Nos. 4,205,838 to T. J. McIntosh, 4,249,726 to R. O. Faust, 4,650,186 to M. J. McCreery et al, 4,799,673 to R. W. Selle and 4,799,674 to D. C. Ochab.

It is therefore proposed to provide a portable safety device for bench pressing which can be easily placed on and removed from a weight training bench for the purpose of protecting the head, neck and shoulders of the weight lifter and avoid accidental dropping or falling of a barbell onto the weight lifter in the course of performing bench press exercises.

SUMMARY OF THE INVENTION

It is therefore an object of the present invention to provide for a novel and improved safety device which can be utilized in combination with a weight training bench to protect a weight lifter from accidental injury from the barbell.

Another object of the present invention is to provide for a novel and improved safety device which will facilitate exercising by a weight lifter on his/her own without danger of injury from inability to return the barbell to its main support and obviates the need for a spotter to assist the weight lifter in performing a series of repetitions.

It is a further object of the present invention to provide for a safety device for bench pressing which is portable, lightweight but extremely rugged and durable in use.

A further object of the present invention is to provide for a novel and improved safety device for use in combination with a weight lifting bench to prevent accidental injury to the weight lifter when in a prone position on the bench and in performing bench press exercises.

A still further object of the present invention is to provide for a novel and improved safety device usable alone or in combination with a weight lifting bench and which is conformable for use by weight lifters of different size and weight without necessitating adjustment for each weight lifter or user; and further wherein the device can be releasably but securely mounted on a weight lifter's bench to avoid injury to the head, neck and shoulders of the weight lifter in performing bench press exercises.

In accordance with the present invention, a weight lifter's safety device is adapted for mounting on a flat surface, such as, a weight training bench to prevent injury to the weight lifter in the course of bench pressing and which device comprises a base member resting on the flat surface, a pair of spaced side frames extending upwardly from opposite sides of the base member in spaced parallel relation to one another, each side frame including an upper substantially horizontal frame portion, the side frame members being spaced apart a distance sufficient that a weight lifter may rest his/her head between the side frame members, and the upper substantially horizontal frame portions are spaced above the head of the weight lifter when the head is resting between the side frame members, and a horizontal extension at the forward end of each of the side frame members extends over the shoulders of the weight lifter when the head is resting on the flat surface between the side frame members.

Preferably, the base member is designed such that it will fit over benches of different width without direct attachment to the bench and thereby can be easily removed when not in use and to free the bench for other uses. The side frame members are open frame members with front and rear vertical legs, and the upper substantially horizontal frame portions are interconnected between the front and rear legs with an upper portion of each forward extension defining a continuation of each substantially horizontal frame portion to extend over the shoulders of the weight lifter. In addition, an extension bracket may be releasably clamped to the forward extension to adjust the depth of the extension to different sized weight lifters.

The above and other objects of the present invention will become more readily appreciated and understood from a consideration of the following detailed description of a preferred embodiment when taken together with the accompanying drawings wherein:

DETAILED DESCRIPTION OF THE PREFERRED EMBODIMENT

Figure 1:
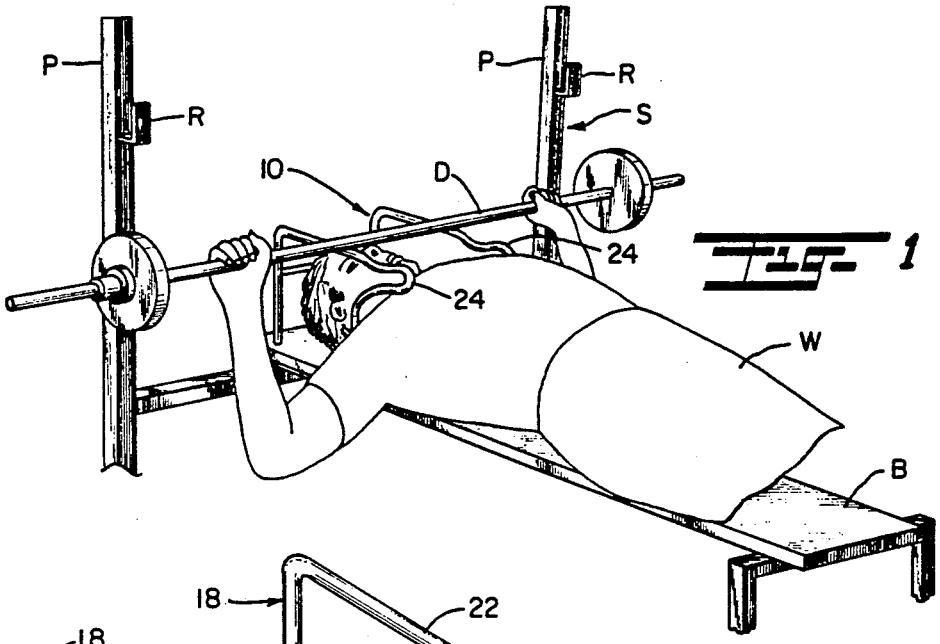
FIG. 1 is a somewhat perspective view illustrating the preferred form of safety device in use in performing bench pressing exercises.
Figure 2:
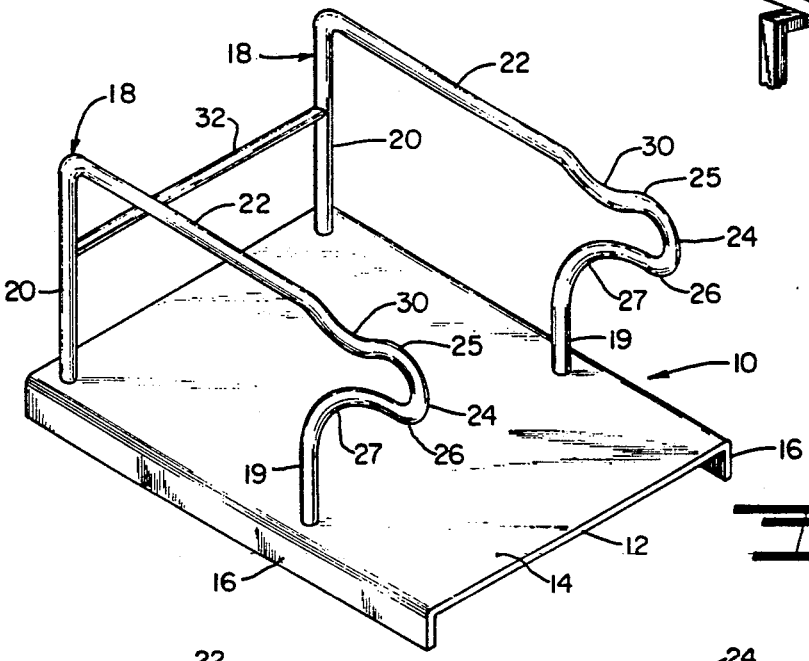
FIG. 2 is another perspective view in more detailed of the preferred form of safety device in accordance with the present invention.

Referring in more detail to the drawings, there is shown by way of illustrative example in FIG. 1 a preferred form of bench press safety device 10 mounted at one end of a weight training bench B for a weight lifter W and a suitable barbell support stand S also being positioned at the one end of the bench B and comprising a pair of standards or posts P in spaced parallel relation to one another. Each post P has a barbell support rest R so as to permit the weight lifter W to position the barbell D in the rests R at completion of a series of repetitions or exercises. Of course, the foregoing is merely representative of various different types of bench press stands that are available for use in performing a series of bench press exercises.

The preferred form of safety device 10 comprises a base frame 12 made up of a flat, generally rectangular plate 14 and which terminates along opposite side edges in downwardly directed flanges 16 and which in combination with the flat plate 14 defines a generally concave underside for fitting over the standard weight training bench B. A pair of side frame members 18 extend upwardly from opposite sides of the flat plate 14, each side frame member including front and rear vertical legs 19 and 20, respectively, and an upper, substantially horizontal frame portion 22 interconnecting the front and rear legs. In addition, each side frame member includes a horizontal extension 24 at its forward end and which includes an upper portion 25 forming a forward horizontal continuation of frame portion 22, a forwardmost reverse curved extremity 26 and a lower portion 27 which curves downwardly from the forward extremity 26 into the vertical leg 19. Preferably, each horizontal continuation 25 has a notched or depressed area 30 at a point just forwardly of the front leg 19 and to serve as a rest for the barbell in the event of a failed exercise. In addition, a cross brace 32 extends between the rear legs 20 of the side frame members 18 to further rigidify the side frame members and maintain them in spaced parallel relation to one another.

In the preferred form, the safety device 10 is composed entirely of high strength metal parts which are capable of withstanding barbells which typically are capable of supporting 500 lbs. or more. The side frame members 18 are spaced a sufficient distance apart to permit the head of the weight lifter W to be placed between the frame members 18 and with the upper frame portions 22 spaced above the head and neck and the forward extensions 24 clearing the shoulders and upper portion of the torso of the weight lifter.

In use, the safety device is placed over the top surface of the bench B toward one end with the side flanges 16 flanking opposite sides of the bench to minimize any shifting or displacement of the safety device with respect to the bench. The weight lifter W will assume a prone position with the head placed between the side members 18 and the extensions 24 spaced above the upper torso as described. The barbell will be positioned on the rests R so that the weight lifter can reach up and grasp the barbell to initiate the bench press. By lifting the barbell off of the rests and performing the desired number of repetitions normally at the end of the exercise the barbell can be repositioned on the supports or rests R. In the event that the weight lifter is unable to complete the exercise or the barbell should slip from the weight lifter's grasp, the upper frame portions 22 will break the fall and prevent the barbell from striking the weight lifter and the weight lifter will be able to guide the barbell into the notched areas 30 so as to prevent it from rolling off of the forward extensions 24.

Figure 3:
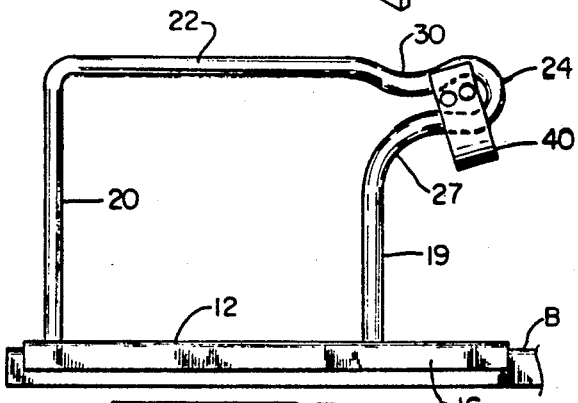
FIG. 3 is a side view in elevation of the preferred form of safety device shown in FIGS. 1 and 2 with an extension bracket mounted on the forward extension of the device.
Figure 4:
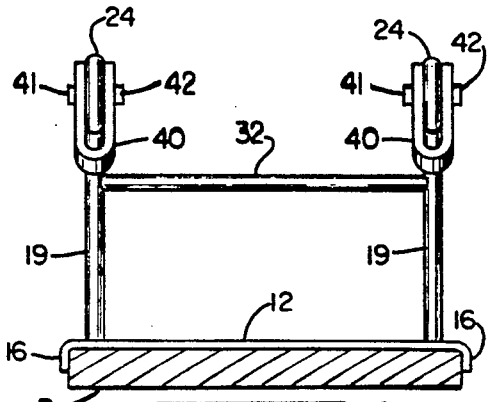
FIG. 4 is a front view in elevation of the modified form of safety device shown in FIG. 3.

It will be evident that the safety device may be positioned on other flat supporting surfaces and accomplish the same ends as hereinbefore described. Further, as illustrated in FIGS. 3 and 4, an extension bracket 40 can be clamped onto the end of the forward extension 24 to extend downwardly and somewhat forwardly beneath the extension as shown. This bracket 40 is provided as an optional accessory and particularly adapted for use with children or smaller persons to eliminate the hazard of the bar accidentally slipping under the extension 24 if it should fall off of the forward extension. The extension bracket 40 is in the form of a generally U-shaped clip in which the upper free ends of the clip or bracket extend over opposite sides of the extension 24 and one or more fasteners in the form of bolts 41 and nuts 42 are inserted through the opening in the extension 24 to clamp upper free ends of the extension bracket 40 tightly against the sides of the extension 24. In this relation, it should be noted that the base frame 12 is dimensioned to extend forwardly beyond the end of the forward extension so that there is no tendency for the device to tip forwardly when the entire weight of the barbell rests on the forward extension 24.

Although the present invention has been described with reference to a preferred embodiment thereof, it is to be understood that various modifications and changes may be made without departing from the spirit and scope of the present invention as defined by the appended claims and reasonable equivalents thereof.

I claim:

1. In weight lifting apparatus wherein a weight training bench is provided for supporting a weight lifter in a supine position, the improvement comprising:

a base member releasably mounted on said bench;

a pair of spaced side frame extending upwardly from said base member in spaced parallel relation to one another, each said side frame including an upper substantially horizontal frame portion, said side frame members spaced apart a distance sufficient that a weight lifter may rest his/her head between said side frame members, and said upper horizontal frame portion spaced above the head of the weight lifter when the head is resting between said side frame members; and a horizontal extension at a forward end of each said side frame member extending over the shoulders of the weight lifter when the head is resting between said side frame members.

2. In apparatus according to claim 1, said base member having a curved underside to fit over a top surface of bench.

3. In apparatus according to claim 2, said curved underside of said base member being of concave configuration with downwardly extending flanges on opposite sides to extend over opposite sides of said bench.

4. In apparatus according to claim 1, said side frame members being generally U-shaped having front and rear vertical legs extending upwardly from said base member and said upper substantially horizontal frame portion extending between said front and rear legs.

5. In apparatus according to claim 1, each of said horizontal extensions defining a forward continuation of said upper substantially horizontal frame portion.

6. In apparatus according to claim 5, each of said front legs having an upper forwardly curved portion defining a lower portion of each of said horizontal extensions.

7. In apparatus according to claim 1, including a cross brace extending across said rear legs, and said base member extending forwardly beyond said horizontal extension.

8. In apparatus according to claim 1, said horizontal extensions including a weight lifting bar support portion on each said horizontal extension.

9. In apparatus according to claim 8, each of said bar supports defined by a notched portion in each of said horizontal extensions.

10. In weight lifting apparatus wherein a weight training bench is provided for supporting a weight lifter in a supine position, the improvement comprising:

a base member disposed on said bench, said base member being of concave configuration with downwardly extending flanges on opposite sides to extend over opposite sides of said bench;

a pair of spaced side frames extending upwardly from said base in spaced parallel relation to one another, each said side frame including an upper substantially horizontal frame portion, each of said side frame members being generally U-shaped having front and rear vertical legs extending upwardly from said base member and said upper substantially horizontal frame portion extending between said front and rear legs, said side frame members spaced apart a distance sufficient that a weight lifter may rest his/her head between said side frame members, and said upper horizontal frame portion spaced above the head of the weight lifter when the head is resting between said side frame members; and a horizontal extension at a forward end of each said side frame member extending over the shoulders of the weight lifter when the head is resting between said side frame members, each of said horizontal extensions defining a forward continuation of said upper substantially horizontal frame portion.

11. In apparatus according to claim 10, said extensions including a weight lifting bar support portion on said horizontal extension, each of said bar portions defined by a notched portion in each of said horizontal extensions, and an extension bracket extending downwardly from said horizontal extension.

* * * * *